US009618195B2

(12) United States Patent
O'Brien-Bernini et al.

(10) Patent No.: US 9,618,195 B2
(45) Date of Patent: Apr. 11, 2017

(54) SEALING COVER FOR A RECESSED LIGHT

(71) Applicant: Owens Corning Intellectual Capital, LLC, Toledo, OH (US)

(72) Inventors: Frank Charles O'Brien-Bernini, Granville, OH (US); David Herman Wolf, Newark, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 161 days.

(21) Appl. No.: 14/533,550

(22) Filed: Nov. 5, 2014

(65) Prior Publication Data

US 2015/0131296 A1 May 14, 2015

Related U.S. Application Data

(60) Provisional application No. 61/901,487, filed on Nov. 8, 2013.

(51) Int. Cl.

| | |
|---|---|
| ***F21V 31/00*** | (2006.01) |
| ***F21V 17/10*** | (2006.01) |
| ***F21V 25/12*** | (2006.01) |
| ***F21V 3/00*** | (2015.01) |
| *F21V 15/01* | (2006.01) |
| *F21V 7/00* | (2006.01) |
| *F21Y 101/00* | (2016.01) |

(52) U.S. Cl.

CPC ..... *F21V 31/005* (2013.01); *F21V 3/00* (2013.01); *F21V 17/105* (2013.01); *F21V 25/12* (2013.01); *F21V 7/00* (2013.01); *F21V 15/01* (2013.01); *F21Y 2101/00* (2013.01)

(58) Field of Classification Search

CPC ... F21V 3/00; F21V 7/00; F21V 15/01; F21V 17/105; F21V 25/12; F21V 31/005; F21Y 2101/02; F21Y 2101/00

See application file for complete search history.

(56) References Cited

U.S. PATENT DOCUMENTS

2006/0109660 A1* 5/2006 Wolf ..... E04B 9/006 362/365
2007/0183154 A1* 8/2007 Robson ..... F21V 3/04 362/267

* cited by examiner

*Primary Examiner* — Stephen F Husar
(74) *Attorney, Agent, or Firm* — Calfee, Halter & Griswold LLP

(57) ABSTRACT

A recessed lighting fixture includes a housing, a baffle, a trim ring, a cover, and at least one attachment element. The housing includes an inner wall and side walls extending to an open outer end. The baffle is secured to the housing by at least one fastening element and includes a reflector wall extending through the outer end of the housing. The trim ring extends radially outward from the reflector wall beyond the outer end of the housing and defines a central opening. The cover includes a light transmitting panel and an attachment ring extending around an outer periphery of the light transmitting panel, with the attachment ring being sized and shaped to cover a circumference of the trim ring. The at least one attachment element secures the attachment ring to the trim ring, such that an air seal is effected between the attachment ring and the trim ring.

49 Claims, 5 Drawing Sheets

SEALING COVER FOR A RECESSED LIGHT

CROSS-REFERENCE TO RELATED APPLICATION

This application claims priority to and the benefit of U.S. Provisional Patent Application Ser. No. 61/901,487, entitled "SEALING COVER FOR A RECESSED LIGHT" and filed Nov. 8, 2013, the entire disclosure of which is incorporated herein by reference.

BACKGROUND

Recessed light fixtures typically include a housing affixed to, and extending into, a ceiling, wall, or other such structure, a trim mounted to the housing, and a lamp socket extending through an opening in the inner wall of the housing. A standard trim includes a laterally outwardly projecting trim ring at its outer end for engaging the structure surface in order to cover the edge of a hole in the structure through which the trim extends.

Recessed light fixtures, mounted in holes formed in ceilings or walls, represent a potential source of air exchange between the heated (or air conditioned) living space below the ceiling and the non-climate controlled spaces beyond the ceiling and walls. Gaps between the trim ring and the ceiling hole, and seams or openings in the housing may provide primary leak paths in a conventional recessed lighting fixture.

SUMMARY

In accordance with an exemplary embodiment of the present application, a recessed lighting fixture includes a housing, a baffle, a trim ring, a cover, and at least one attachment element. The housing includes an inner wall and side walls extending to an open outer end. The baffle is secured to the housing by at least one fastening element and includes a reflector wall extending through the outer end of the housing. The trim ring extends radially outward from the reflector wall beyond the outer end of the housing and defines a central opening. The cover includes a light transmitting panel and an attachment ring extending around an outer periphery of the light transmitting panel, with the attachment ring being sized and shaped to cover a circumference of the trim ring. The at least one attachment element secures the attachment ring to the trim ring, such that an air seal is effected between the attachment ring and the trim ring.

According to another exemplary embodiment, a method of providing an enhanced air seal over a central opening of a recessed lighting fixture is contemplated, with the recessed lighting fixture including a housing installed in an opening in an external structure and having an inner wall and side walls extending to an open outer end, a baffle secured to the housing by at least one fastening element and including a reflector wall extending through the outer end of the housing, and a trim ring extending radially outward from the reflector wall beyond the outer end of the housing, the trim ring defining a central opening. In the exemplary method, a cover is provided, including a light transmitting panel and an attachment ring extending around an outer periphery of the light transmitting panel. The attachment ring is secured to the trim ring such that the attachment ring covers a circumference of the trim ring. An air seal is effected between the trim ring and the attachment ring.

According to still another exemplary embodiment, a kit for providing an enhanced air seal over a central opening of a recessed lighting fixture is contemplated with the recessed lighting fixture including a housing installed in an opening in an external structure and having an inner wall and side walls extending to an open outer end, a baffle secured to the housing by at least one fastening element and including a reflector wall extending through the outer end of the housing, and a trim ring extending radially outward from the reflector wall beyond the outer end of the housing, the trim ring defining a central opening. The exemplary kit includes a cover and a magnetic ring. The cover includes a light transmitting panel and an attachment ring extending around an outer periphery of the light transmitting panel, with the attachment ring including a ferromagnetic material disposed around a circumference of the attachment ring. The magnetic ring is sized to align with the circumference of the attachment ring, with the magnetic ring including an adhesive backing for affixing the magnetic ring to an outer surface of the trim ring of the recessed lighting fixture. The magnetic ring is configured to effect an air seal between the cover and the trim ring when the magnetic ring is affixed to the outer surface of the trim ring and the attachment ring is magnetically attached to the magnetic ring.

BRIEF DESCRIPTION OF THE DRAWINGS

In the accompanying drawings which are incorporated in and constitute a part of the specification, embodiments of the invention are illustrated, which, together with a general description of the invention given above, and the detailed description given below, serve to provide examples of the principles of this invention.

DETAILED DESCRIPTION

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

The Detailed Description merely describes exemplary embodiments and is not intended to limit the scope of the claims in any way. Indeed, the invention as claimed and described is broader than and unlimited by the exemplary embodiments, and the terms used in the claims have their full ordinary meaning For example, while the specific embodiments described herein relate to air seal cover arrangements for existing recessed lighting fixtures installed in ceilings, one or more of the inventive features described herein may additionally or alternatively be applied to new recessed lights or other such recessed fixtures installed in a variety of external structures.

Figure 1:
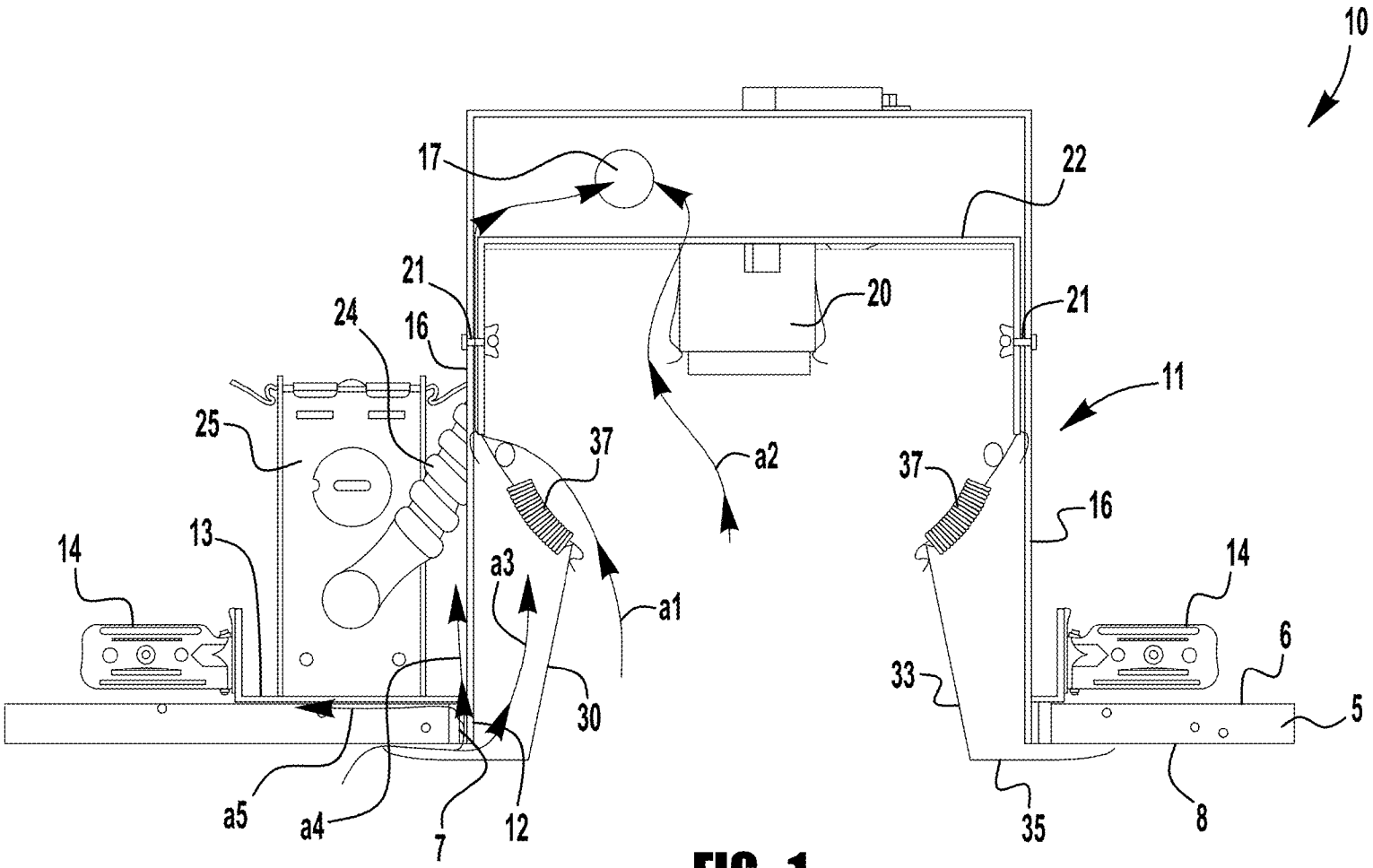
FIG. 1 is a cross-sectional side view of an exemplary embodiment of a recessed light fixture.

FIG. 1 illustrates an exemplary recessed lighting fixture 10 having a housing 11 with an open end 12 sized to fit through an opening 7 in a ceiling 5 (or other external structure). A base plate 13 extends from an outer periphery of the open end 12 for abutment with an upper or inner surface 6 of the ceiling 5. Hanger bars 14 extend from the base plate 13 for mounting the housing 11 to one or more ceiling or wall joists (not shown).

A lighting socket 20 is provided in an interior of the housing 11, and may be assembled directly with the housing (e.g., through an opening in an upper or inner wall of the housing) or, as shown, with an adjustable plate 22 assembled with the housing 11 by fasteners 21 that allow for adjustment of the position of the lighting socket 20 (and installed lighting element, not shown) within the housing. An insulated power connection 24 extends between the socket 20 and a junction box 25 mounted to the housing base plate 13 to provide an electrical connection between the socket and an external power source (not shown).

A baffle 30 is assembled with the housing 11 to provide a generally frustoconical reflector wall 33 for the installed lighting element. A trim ring 35, either integral to or assembled with the reflector wall 33, extends radially outward of an outer end of the reflector wall, to cover the edge of the housing 11 and the ceiling opening 7, and to define a central opening 36 through which light from the lighting element is directed. The baffle 30 is secured to the housing 11 by springs 37 each having a first end secured to an inner portion of the baffle and a second end secured to side walls 16 of the housing 11. The springs 37 exert an upward biasing force on the trim ring 35 to hold the trim ring against the lower or outer surface 8 of the ceiling.

Small gaps between the housing 11 and the ceiling opening 7 and seams and openings in the housing 11 (e.g., between the adjustable plate 22 and the housing 11, or between the socket 20 and the adjustable plate 22, and through a wiring aperture 17 in the housing) present air leak paths a1, a2 between the climate controlled living space and an outer envelope of the building.

According to an exemplary aspect of the present application, an existing recessed light fixture having a conventional trim ring may be adapted to include a sealing cover providing an enhanced air seal over the central opening in the trim ring, thereby sealing leak paths through the housing and between the housing and the ceiling opening.

Figure 2:
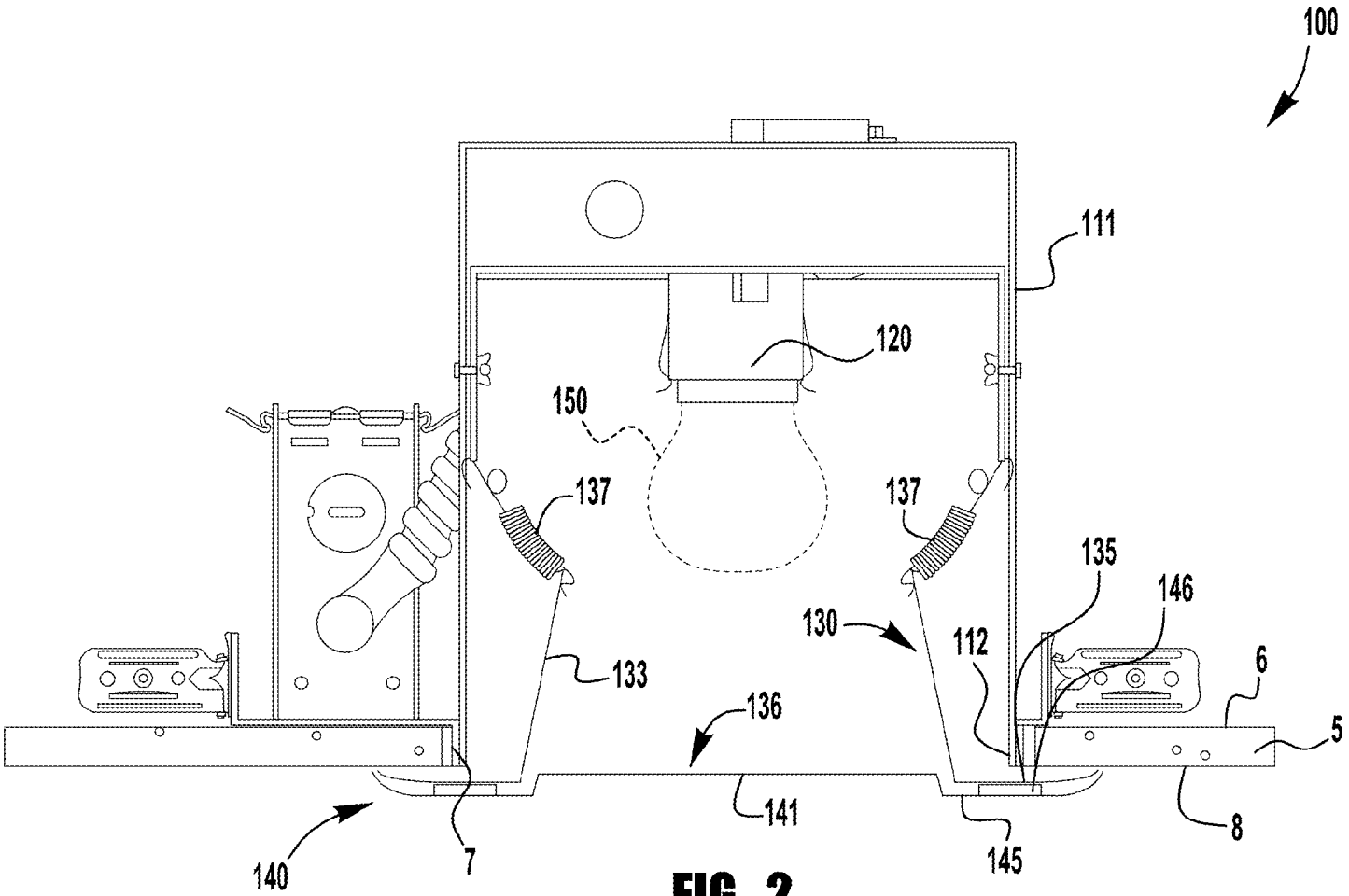
FIG. 2 is a cross-sectional side view of an exemplary embodiment of a recessed light assembly, shown with a sealing cover arrangement.

FIG. 2 illustrates an exemplary recessed lighting fixture 100 having a housing 111 installed in a ceiling opening 7 and retaining a socket 120 for installation of a lighting element 150. A baffle 130 is assembled with the housing 111 and includes a reflector wall 133 and a trim ring 135 extending radially outward of the reflector wall to cover the edge of the housing 111 and the ceiling opening 7, and to define a central opening 136 through which light from the lighting element 150 is directed. Fastening elements 137 (e.g., springs) secure the baffle 130 to the housing 111 and hold the trim ring 135 against the ceiling surface 8.

To seal the open outer end 112 of the housing 111, a cover 140 having a light transmitting (e.g., transparent or translucent) panel 141 (e.g., a glass or plastic plate) may be secured to the trim ring 135 to cover the central opening 136. While many different arrangements may be utilized to secure the panel 141 over the central opening 136, in the illustrated embodiment, an attachment ring 145, shaped to correspond to the trim ring 135 (e.g., circular, rectangular, etc.) is secured to an outer periphery of the panel 141. One or more attachment elements 146 may be provided on either or both of the attachment ring 145 and the trim ring 135 to secure the attachment ring to the trim ring.

Various types of attachment elements may be used to secure an outer attachment ring of a seal cover to a trim ring of a recessed lighting fixture, including, for example, one or more fasteners (e.g., screws, bolts), hooks, clips, adhesives, magnets, and/or snap-fit engagement features (e.g., outer lip or prongs). In one embodiment, a ring-shaped attachment element (e.g., ring-shaped magnet, ring of adhesive, or compressible ring with adhesive on both sides) fully encircles the central openings in the trim ring and attachment ring, and provides a seal between the trim ring and the attachment ring. The attachment elements may be configured to facilitate removal of the seal cover from the lighting fixture, for example, to replace a light bulb (or other light source) or to clean or replace the light transmitting panel.

Figure 3:
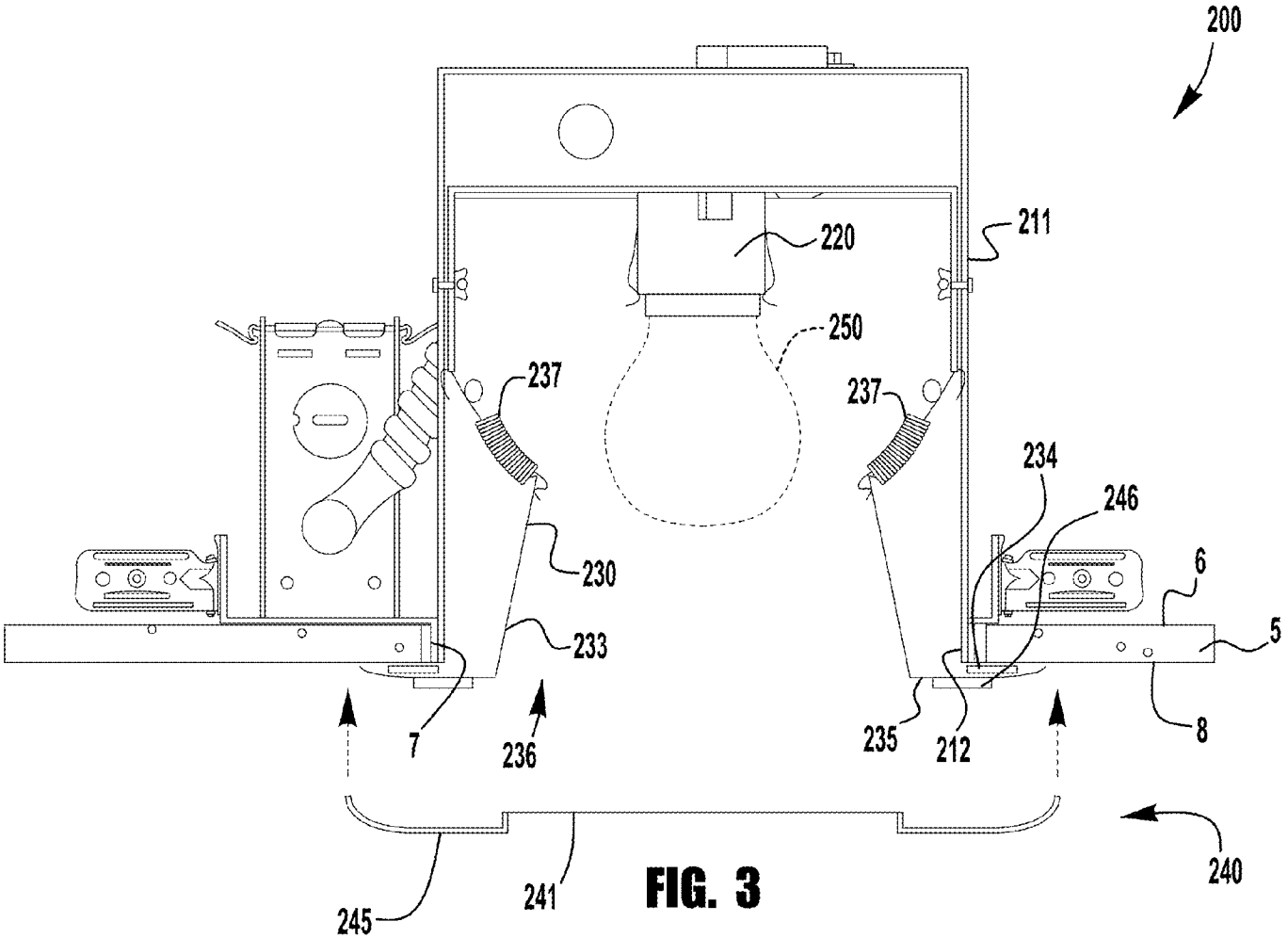
FIG. 3 is a cross-sectional side view of another exemplary embodiment of a recessed light assembly, shown with a sealing cover arrangement disassembled from the light fixture.

FIG. 3 illustrates an exemplary recessed lighting fixture 200 having a housing 211 installed in a ceiling opening 7 and retaining a socket 220 for installation of a lighting element 250. A baffle 230 is assembled with the housing 211 and includes a reflector wall 233 and a trim ring 235 extending radially outward of the reflector wall to cover the edge of the housing 211 and the ceiling opening 7, and to define a central opening 236 through which light from the lighting element is directed. Fastening springs 237 secure the baffle 230 to the housing 211 and hold the trim ring 235 against the ceiling surface 8. To seal the open outer end 212 of the housing 211, a cover 240 having a light transmitting panel 241 (e.g., a glass or plastic plate) is secured to the trim ring 235 to cover the central opening 236. An attachment ring 245 is secured to an outer periphery of the panel 240 by a magnetic ring 246 adhered to the trim ring (e.g., by an adhesive), with at least a portion of the attachment ring 245 including a ferromagnetic material (e.g., steel) for magnetic attachment of the attachment ring 245 to the trim ring. In one embodiment, the adhesive attachment between the trim ring 235 and the magnetic ring 246 and the magnetic attachment between the magnetic ring 246 and the attachment ring 245 provide a generally air tight seal between the trim ring and the attachment ring, while allowing for easy, tool-free detachment of the seal cover 240 from the lighting fixture 200 by pulling on the attachment ring 245. Further, in the illustrated example, the attachment ring 245 is sized and shaped to substantially entirely cover the trim ring 235. The exemplary attachment ring 245 may be provided with an outer surface having the ornamental appearance of a trim ring, to provide the recessed lighting fixture 200 with a finished appearance.

Figure 4:
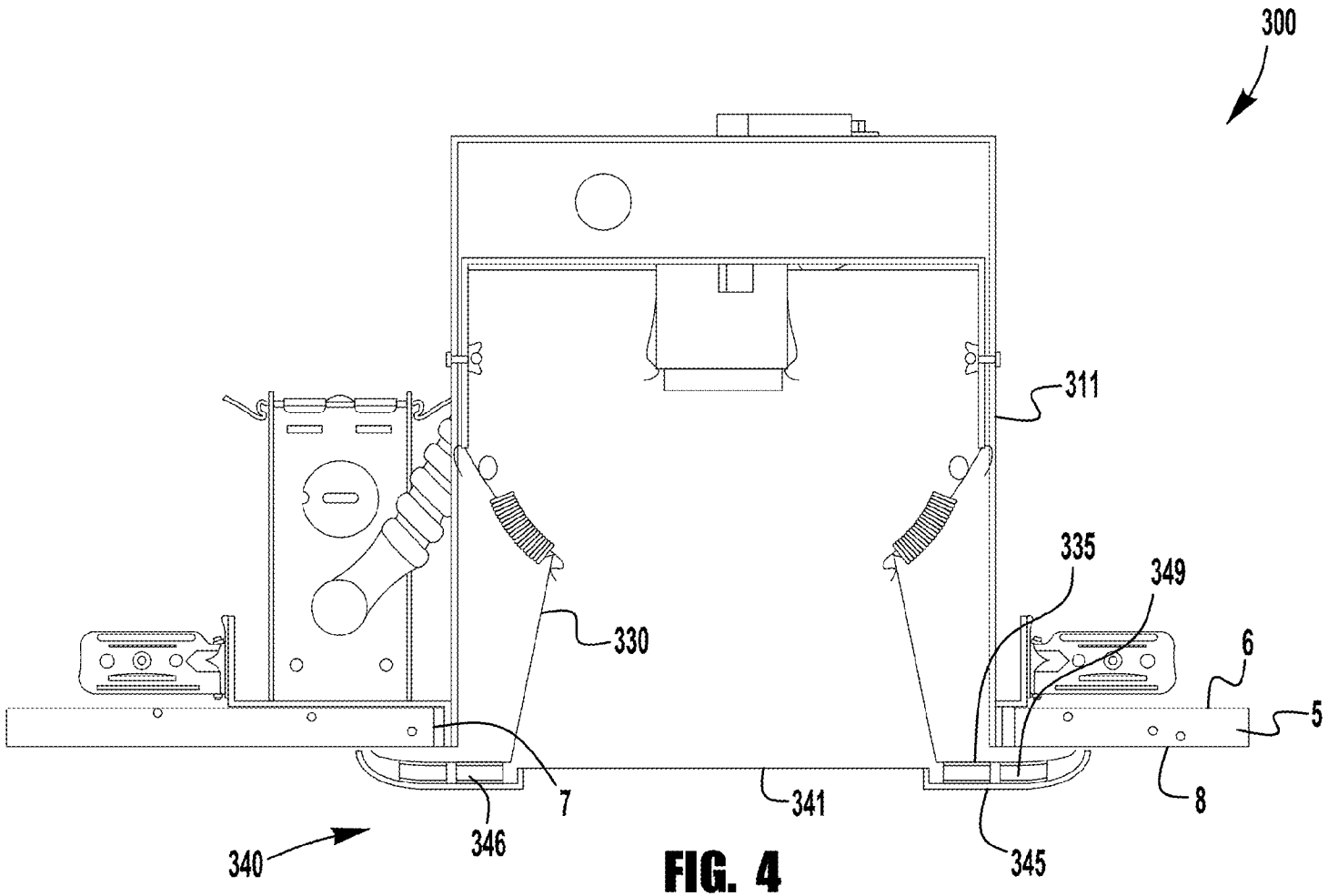
FIG. 4 is a cross-sectional side view of another exemplary embodiment of a recessed light assembly, shown with another sealing cover arrangement.

In other embodiments, for example, where the attachment element(s) provide discrete attachment points between the trim ring and the attachment ring, one or more additional sealing elements (e.g., gaskets, O-rings, compressible pads, caulking) may be positioned between the trim ring and the attachment ring to effect an air seal between the trim ring and the attachment ring. FIG. 4 illustrates an exemplary recessed lighting fixture 300 having an attachment ring 345 secured to a trim ring 335 by attachment elements 346 and a compressible seal ring 349 adhered to at least one of the trim ring 335 and the attachment ring 345 to effect an air seal.

Referring back to FIG. 1, small gaps between the trim ring 35 and the ceiling surface 8 (for example, due to rough or uneven ceiling surfaces) may present additional air leak paths a3 (into gaps and openings in the housing as identified above), a4 (between the base plate 13 and the housing 11), and a5 (between the base plate 13 and the inner surface 6 of the ceiling 5), between the climate controlled living space and the outer envelope of the building. To eliminate this potential leak path, one or more sealing elements may be provided between the ceiling and one or both of the trim ring and the attachment ring. For example, a compressible gasket ring may be installed between the ceiling and the trim ring to provide a seal between the ceiling and the trim ring. An adhesive layer may be applied to one or both sides of the gasket to adhere the gasket in a desired position on either or both of the trim ring and the attachment ring.

In the illustrated embodiment of FIG. 3, a compressible trim ring seal or gasket 234 (e.g., foam or elastomer) is inserted between the ceiling surface 8 and the trim ring 235 to form an air seal around the ceiling opening 7. The gasket 234 includes an adhesive backing that secures the gasket 234 to an underside of the trim ring 235 in a desired position.

In an exemplary method of adapting or retrofitting an existing recessed lighting fixture 200 with an enhanced air sealing arrangement, the baffle 230 is detached from the fastening springs 237 and separated from the fixture housing 211. A compressible gasket 234 is adhered to an underside of the trim ring 235 by the adhesive backing, and the magnetic ring 246 is adhered to an outer surface of the trim ring 235 by an adhesive backing The baffle is then re-attached to the fastening springs 237, with the springs applying sufficient biasing force to compress the gasket 234 between the trim ring 235 and the ceiling surface 8. The ferromagnetic attachment ring 245 of the cover 240 is magnetically attached to the magnetic ring 246 such that the panel 241 substantially covers the open outer end 212 of the housing 211, with the magnetic ring 246 providing an air seal between the trim ring 235 and the attachment ring 245.

Figure 5:
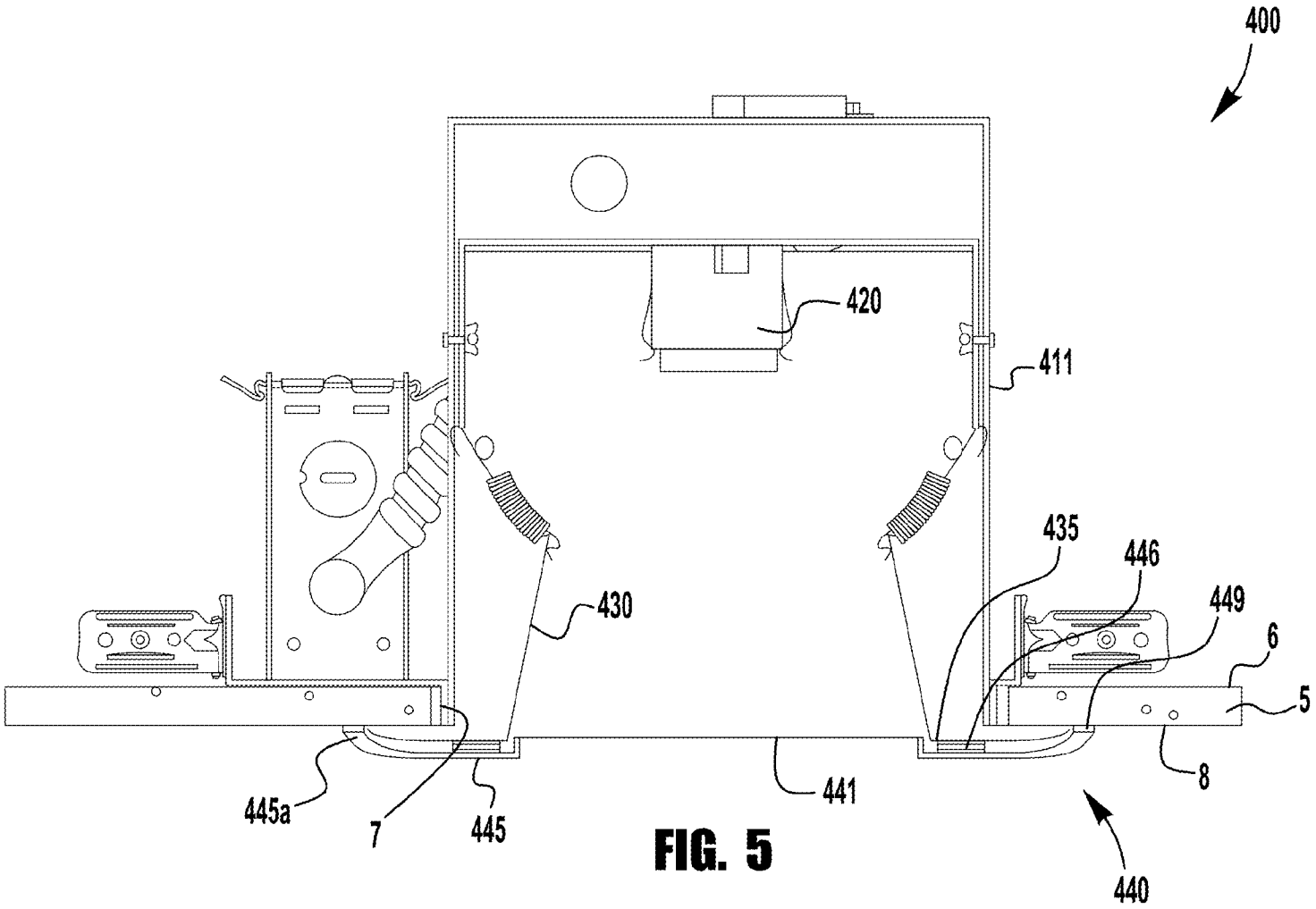
FIG. 5 is a cross-sectional side view of still another exemplary embodiment of a recessed light assembly, shown with yet another sealing cover arrangement.

As another example, a compressible gasket ring may be provided between the ceiling and an outer periphery of the attachment ring, which may eliminate the need to provide a sealing element (or an attachment element that functions as a sealing element) between the trim ring and the attachment ring. FIG. 5 illustrates an exemplary recessed lighting fixture 400 having an attachment ring 445 secured to a trim ring 435 by one or more attachment elements 446 and a compressible seal ring 449 compressed between the ceiling surface 8 and an outer periphery 445*a* of the attachment ring 445 to provide an air seal around the ceiling opening 7. The seal ring 449 may be adhered to either or both of the ceiling surface 8 and the attachment ring outer periphery 445*a* (e.g., by an adhesive backing) to maintain the seal ring 449 in a desired position.

According to another exemplary aspect of the present application, a seal cover for a recessed lighting fixture may be provided with a light transmitting panel selected to provide desirable light transmitting properties, including, for example, dimming, focusing, diffracting, directing, diffusing, color changing, and other such optical effects. The attachment ring may be detachable from the light transmitting panel for replacement of a first light transmitting panel with a second light transmitting panel (having, for example, different light transmitting properties).

In other embodiments, other types of lighting elements may be utilized or incorporated into the recessed light assembly, including, for example, light emitting diode (LED) lighting elements, organic light emitting diode (OLED) elements, fluorescent lights, compact fluorescent lamp (CFL) elements, and other such lighting elements. In some embodiments, where recessed light sealing arrangements (as described above) reduce heat transfer from the recessed lighting fixture housing, use of a low heat lighting element (e.g., fluorescent or LED lighting) may reduce or prevent overheating of the lighting assembly. Additionally or alternatively, one or more heat sinks, as known in the art, may be provided with the lighting element, to promote heat dissipation without permitting air exchange past the lighting unit.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, hardware, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

While the present invention has been illustrated by the description of embodiments thereof, and while the embodiments have been described in considerable detail, it is not the intention of the applicant to restrict or in any way limit the scope of the invention to such detail. Additional advantages and modifications will readily appear to those skilled in the art. For example, the specific locations of the component connections and interplacements can be modified. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A recessed lighting fixture comprising:

a housing having an inner wall and side walls extending to an open outer end;

a baffle secured to the housing by at least one fastening element and including a reflector wall extending through the outer end of the housing;

a trim ring extending radially outward from the reflector wall beyond the outer end of the housing, the trim ring defining a central opening;

a cover, comprising a light transmitting panel and an attachment ring extending around an outer periphery of the light transmitting panel, the attachment ring being sized and shaped to cover a circumference of the trim ring; and at least one attachment element securing the attachment ring to the trim ring, such that an air seal is effected between the attachment ring and the trim ring, wherein the at least one attachment element comprises a magnetic element, and wherein the magnetic element comprises a magnetic ring surrounding the central opening in the trim ring.

2. The recessed lighting fixture of claim 1, wherein the air seal is effected by the at least one attachment element.

3. The recessed lighting fixture of claim 1, further comprising a seal ring compressed between the trim ring and the attachment ring to effect the air seal.

4. The recessed lighting fixture of claim 1, further comprising a compressible trim ring seal assembled with an inner surface of the trim ring and configured to effect an air seal between the trim ring and a surface of an external structure when the recessed lighting fixture is installed in an opening in the external structure.

5. The recessed lighting fixture of claim 4, wherein the trim ring seal is affixed to the inner surface of the trim ring by an adhesive backing disposed on the trim ring seal.

6. The recessed lighting fixture of claim 1, wherein the attachment ring includes an outer periphery extending radially outward of the trim ring, the fixture further including a compressible attachment ring seal assembled with the outer periphery of the attachment ring and configured to effect an air seal between the attachment ring and a surface of an external structure when the recessed lighting fixture is installed in an opening in the external structure.

7. The recessed lighting fixture of claim 1, wherein the attachment ring is sized and shaped to substantially entirely cover the trim ring.

8. A method of providing an enhanced air seal over a central opening of a recessed lighting fixture including a housing installed in an opening in an external structure and having an inner wall and side walls extending to an open outer end, a baffle secured to the housing by at least one fastening element and including a reflector wall extending through the outer end of the housing, and a trim ring extending radially outward from the reflector wall beyond the outer end of the housing, the trim ring defining a central opening, the method comprising:

providing a cover including a light transmitting panel and an attachment ring extending around an outer periphery of the light transmitting panel;

securing the attachment ring to the trim ring such that the attachment ring covers a circumference of the trim ring; and effecting an air seal between the trim ring and the attachment ring, wherein securing the attachment ring to the trim ring comprises affixing a magnetic element to one of the trim ring and the attachment ring, wherein the other of the trim ring and the attachment ring comprises a ferromagnetic material, and wherein the magnetic element comprises a magnetic ring surrounding the central opening in the trim ring.

9. The method of claim 8, wherein the air seal is effected by the at least one attachment element.

10. The method of claim 8, further comprising compressing a seal ring between the trim ring and the attachment ring to effect the air seal.

11. The method of claim 8, further comprising compressing a trim ring seal between an inner surface of the trim ring and an outer surface of the external structure to effect an air seal between the trim ring and the outer surface of the external structure.

12. The method of claim 11, further comprising affixing the trim ring seal to the inner surface of the trim ring by an adhesive backing disposed on the trim ring seal.

13. The method of claim 8, further comprising compressing an attachment ring seal between an inner surface of an outer periphery of the attachment ring and an outer surface of the external structure to effect an air seal between the attachment ring and the outer surface of the external structure, the outer periphery of the attachment ring extending radially outward of the trim ring.

14. The method of claim 8, wherein securing the attachment ring to the trim ring such that the attachment ring covers a circumference of the trim ring comprises substantially entirely covering the trim ring.

15. A kit for providing an enhanced air seal over a central opening of a recessed lighting fixture including a housing installed in an opening in an external structure and having an inner wall and side walls extending to an open outer end, a baffle secured to the housing by at least one fastening element and including a reflector wall extending through the outer end of the housing, and a trim ring extending radially outward from the reflector wall beyond the outer end of the housing, the trim ring defining a central opening, the kit comprising:

a cover including a light transmitting panel and an attachment ring extending around an outer periphery of the light transmitting panel, the attachment ring including a ferromagnetic material disposed around a circumference of the attachment ring;

a magnetic ring sized to align with the circumference of the attachment ring, the magnetic ring including an adhesive backing for affixing the magnetic ring to an outer surface of the trim ring of the recessed lighting fixture, the magnetic ring being configured to effect an air seal between the cover and the trim ring when the magnetic ring is affixed to the outer surface of the trim ring and the attachment ring is magnetically attached to the magnetic ring.

16. The kit of claim 15, further comprising a compressible trim ring seal compressible trim ring seal including an adhesive backing for affixing the trim ring seal to an inner surface of the trim ring, the trim ring seal being configured to effect an air seal between the trim ring and a surface of an external structure when the recessed lighting fixture is installed in an opening in the external structure.

17. A recessed lighting fixture comprising:

a housing having an inner wall and side walls extending to an open outer end;

a baffle secured to the housing by at least one fastening element and including a reflector wall extending through the outer end of the housing;

a trim ring extending radially outward from the reflector wall beyond the outer end of the housing, the trim ring defining a central opening;

a cover, comprising a light transmitting panel and an attachment ring extending around an outer periphery of the light transmitting panel, the attachment ring being sized and shaped to cover a circumference of the trim ring; and at least one attachment element securing the attachment ring to the trim ring, such that an air seal is effected between the attachment ring and the trim ring, wherein the at least one attachment element comprises a magnetic element, and wherein the magnetic element is affixed to the trim ring by an adhesive backing disposed on the magnetic element, and the attachment ring comprises a ferromagnetic material.

18. The recessed lighting fixture of claim 17, wherein the air seal is effected by the at least one attachment element.

19. The recessed lighting fixture of claim 17, further comprising a seal ring compressed between the trim ring and the attachment ring to effect the air seal.

20. The recessed lighting fixture of claim 17, further comprising a compressible trim ring seal assembled with an inner surface of the trim ring and configured to effect an air seal between the trim ring and a surface of an external structure when the recessed lighting fixture is installed in an opening in the external structure.

21. The recessed lighting fixture of claim 20, wherein the trim ring seal is affixed to the inner surface of the trim ring by an adhesive backing disposed on the trim ring seal.

22. The recessed lighting fixture of claim 17, wherein the attachment ring includes an outer periphery extending radially outward of the trim ring, the fixture further including a compressible attachment ring seal assembled with the outer periphery of the attachment ring and configured to effect an air seal between the attachment ring and a surface of an external structure when the recessed lighting fixture is installed in an opening in the external structure.

23. The recessed lighting fixture of claim 17, wherein the attachment ring is sized and shaped to substantially entirely cover the trim ring.

24. A recessed lighting fixture comprising:

a housing having an inner wall and side walls extending to an open outer end;

a baffle secured to the housing by at least one fastening element and including a reflector wall extending through the outer end of the housing;

a trim ring extending radially outward from the reflector wall beyond the outer end of the housing, the trim ring defining a central opening;

a cover, comprising a light transmitting panel and an attachment ring extending around an outer periphery of the light transmitting panel, the attachment ring being sized and shaped to cover a circumference of the trim ring;

at least one attachment element securing the attachment ring to the trim ring, such that an air seal is effected between the attachment ring and the trim ring; and a compressible trim ring seal assembled with an inner surface of the trim ring and configured to effect an air seal between the trim ring and a surface of an external structure when the recessed lighting fixture is installed in an opening in the external structure.

25. The recessed lighting fixture of claim 24, wherein the at least one attachment element comprises a magnetic element.

26. The recessed lighting fixture of claim 25, wherein the magnetic element comprises a magnetic ring surrounding the central opening in the trim ring.

27. The recessed lighting fixture of claim 25, wherein the magnetic element is affixed to one of the trim ring and the attachment ring, and the other of the trim ring and the attachment ring comprises a ferromagnetic material.

28. The recessed lighting fixture of claim 25, wherein the magnetic element is affixed to the trim ring by an adhesive backing disposed on the magnetic element, and the attachment ring comprises a ferromagnetic material.

29. The recessed lighting fixture of claim 24, wherein the air seal is effected by the at least one attachment element.

30. The recessed lighting fixture of claim 24, further comprising a seal ring compressed between the trim ring and the attachment ring to effect the air seal.

31. The recessed lighting fixture of claim 24, wherein the trim ring seal is affixed to the inner surface of the trim ring by an adhesive backing disposed on the trim ring seal.

32. The recessed lighting fixture of claim 24, wherein the attachment ring includes an outer periphery extending radially outward of the trim ring, the fixture further including a compressible attachment ring seal assembled with the outer periphery of the attachment ring and configured to effect an air seal between the attachment ring and a surface of an external structure when the recessed lighting fixture is installed in an opening in the external structure.

33. The recessed lighting fixture of claim 24, wherein the attachment ring is sized and shaped to substantially entirely cover the trim ring.

34. A method of providing an enhanced air seal over a central opening of a recessed lighting fixture including a housing installed in an opening in an external structure and having an inner wall and side walls extending to an open outer end, a baffle secured to the housing by at least one fastening element and including a reflector wall extending through the outer end of the housing, and a trim ring extending radially outward from the reflector wall beyond the outer end of the housing, the trim ring defining a central opening, the method comprising:

providing a cover including a light transmitting panel and an attachment ring extending around an outer periphery of the light transmitting panel;

securing the attachment ring to the trim ring such that the attachment ring covers a circumference of the trim ring; and effecting an air seal between the trim ring and the attachment ring, wherein securing the attachment ring to the trim ring comprises affixing a magnetic element to one of the trim ring and the attachment ring, wherein the other of the trim ring and the attachment ring comprises a ferromagnetic material, and wherein affixing the magnetic element to the one of the trim ring and the attachment ring comprises affixing the magnetic element to the trim ring by an adhesive backing disposed on the magnetic element.

35. The method of claim 34, wherein the air seal is effected by the at least one attachment element.

36. The method of claim 34, further comprising compressing a seal ring between the trim ring and the attachment ring to effect the air seal.

37. The method of claim 34, further comprising compressing a trim ring seal between an inner surface of the trim ring and an outer surface of the external structure to effect an air seal between the trim ring and the outer surface of the external structure.

38. The method of claim 37, further comprising affixing the trim ring seal to the inner surface of the trim ring by an adhesive backing disposed on the trim ring seal.

39. The method of claim 34, further comprising compressing an attachment ring seal between an inner surface of an outer periphery of the attachment ring and an outer surface of the external structure to effect an air seal between the attachment ring and the outer surface of the external structure, the outer periphery of the attachment ring extending radially outward of the trim ring.

40. The method of claim 34, wherein securing the attachment ring to the trim ring such that the attachment ring covers a circumference of the trim ring comprises substantially entirely covering the trim ring.

41. A method of providing an enhanced air seal over a central opening of a recessed lighting fixture including a housing installed in an opening in an external structure and having an inner wall and side walls extending to an open outer end, a baffle secured to the housing by at least one fastening element and including a reflector wall extending through the outer end of the housing, and a trim ring extending radially outward from the reflector wall beyond the outer end of the housing, the trim ring defining a central opening, the method comprising:

providing a cover including a light transmitting panel and an attachment ring extending around an outer periphery of the light transmitting panel;

securing the attachment ring to the trim ring such that the attachment ring covers a circumference of the trim ring;

effecting an air seal between the trim ring and the attachment ring; and compressing a trim ring seal between an inner surface of the trim ring and an outer surface of the external structure to effect an air seal between the trim ring and the outer surface of the external structure.

42. The method of claim 41, wherein securing the attachment ring to the trim ring comprises affixing a magnetic element to one of the trim ring and the attachment ring, wherein the other of the trim ring and the attachment ring comprises a ferromagnetic material.

43. The method of claim 42, wherein the magnetic element comprises a magnetic ring surrounding the central opening in the trim ring.

44. The method of claim 42, wherein affixing the magnetic element to the one of the trim ring and the attachment ring comprises affixing the magnetic element to the trim ring by an adhesive backing disposed on the magnetic element.

45. The method of claim 41, wherein the air seal is effected by the at least one attachment element.

46. The method of claim 41, further comprising compressing a seal ring between the trim ring and the attachment ring to effect the air seal.

47. The method of claim 41, further comprising affixing the trim ring seal to the inner surface of the trim ring by an adhesive backing disposed on the trim ring seal.

48. The method of claim 41, further comprising compressing an attachment ring seal between an inner surface of an outer periphery of the attachment ring and an outer surface of the external structure to effect an air seal between the attachment ring and the outer surface of the external structure, the outer periphery of the attachment ring extending radially outward of the trim ring.

49. The method of claim 41, wherein securing the attachment ring to the trim ring such that the attachment ring covers a circumference of the trim ring comprises substantially entirely covering the trim ring.

* * * * *